US005795083A

United States Patent [19]

Gallagher

[11] Patent Number: 5,795,083

[45] Date of Patent: Aug. 18, 1998

[54] THERMAL TRANSFER RIBBON CASSETTE

[75] Inventor: Brendan Francis Gallagher, Ipswich, United Kingdom

[73] Assignee: Imperial Chemical Industries PLC, United Kingdom

[21] Appl. No.: 693,081

[22] PCT Filed: Jan. 16, 1995

[86] PCT No.: PCT/GB95/00075

§ 371 Date: Feb. 5, 1997

§ 102(e) Date: Feb. 5, 1997

[87] PCT Pub. No.: WO95/19889

PCT Pub. Date: Jul. 27, 1995

[30] Foreign Application Priority Data

Jan. 20, 1994 [GB] United Kingdom ..... 94010550

[51] Int. Cl.[6] ..... B41J 35/28

[52] U.S. Cl. ..... 400/207; 400/242

[58] Field of Search ..... 400/207, 208.1, 400/208, 242, 247

[56] References Cited

U.S. PATENT DOCUMENTS

| | | | |
|---|---|---|---|
| 4,413,557 | 11/1983 | Wade et al. | 400/242 |
| 4,673,304 | 6/1987 | Liu et al. | 400/208 |
| 5,110,228 | 5/1992 | Yokomizo | 400/208 |
| 5,238,314 | 8/1993 | Kitahara | 400/208 |
| 5,352,049 | 10/1994 | Shiraishi et al. | 400/208 |
| 5,399,034 | 3/1995 | Fujii et al. | 400/207 |
| 5,455,617 | 10/1995 | Stephenson et al. | 400/208.1 |

FOREIGN PATENT DOCUMENTS

| | | | |
|---|---|---|---|
| 0 358 520 | 3/1990 | European Pat. Off. . | |
| 0 398 482 | 11/1990 | European Pat. Off. . | |
| 2687606 | 8/1993 | France | 400/208 |

OTHER PUBLICATIONS

Patents Abstracts of Japan, vol. 11, No. 50 (M-562) (2497), Feb. 17, 1987 & JP. A, 61 213 180 (T. Kase) Sep. 22, 1986.

Patents Abstracts of Japan, vol. 11, No. 50 (M-562) (2497), Feb. 17, 1987 & JP. A, 61 213 181 (T. Kase) Sep. 22, 1986.

*Primary Examiner*—Edgar S. Burr
*Assistant Examiner*—Anthony H. Nguyen

[57] ABSTRACT

A thermal transfer ribbon cassette comprises a supply (1B), a take-up spool (1A) and a molded casing (10); each spool having end portions (2, 3) and a bobbin portion (4) on which is wound one end of the transfer ribbon (5), the molded casing having locating (15, 16) means for engaging the spool ends while the spools are in parallel and spaced apart positions with the transfer ribbon extending between them, and means to retain the spool in such position comprising a closable gate (30) connected to the casing by an integrally molded hinge (31). Locating means for engaging a spindle at the undriven end of each spool, suitably comprises a trough having an internal bearing surface and a longitudinal opening (27) to receive the spindle into contact with the bearing surface, the gate (30) being closable across the trough opening to retain spindle (3). This permits a simple design for a relatively cheap, one-piece molded casing, which can be refillable if required.

12 Claims, 1 Drawing Sheet

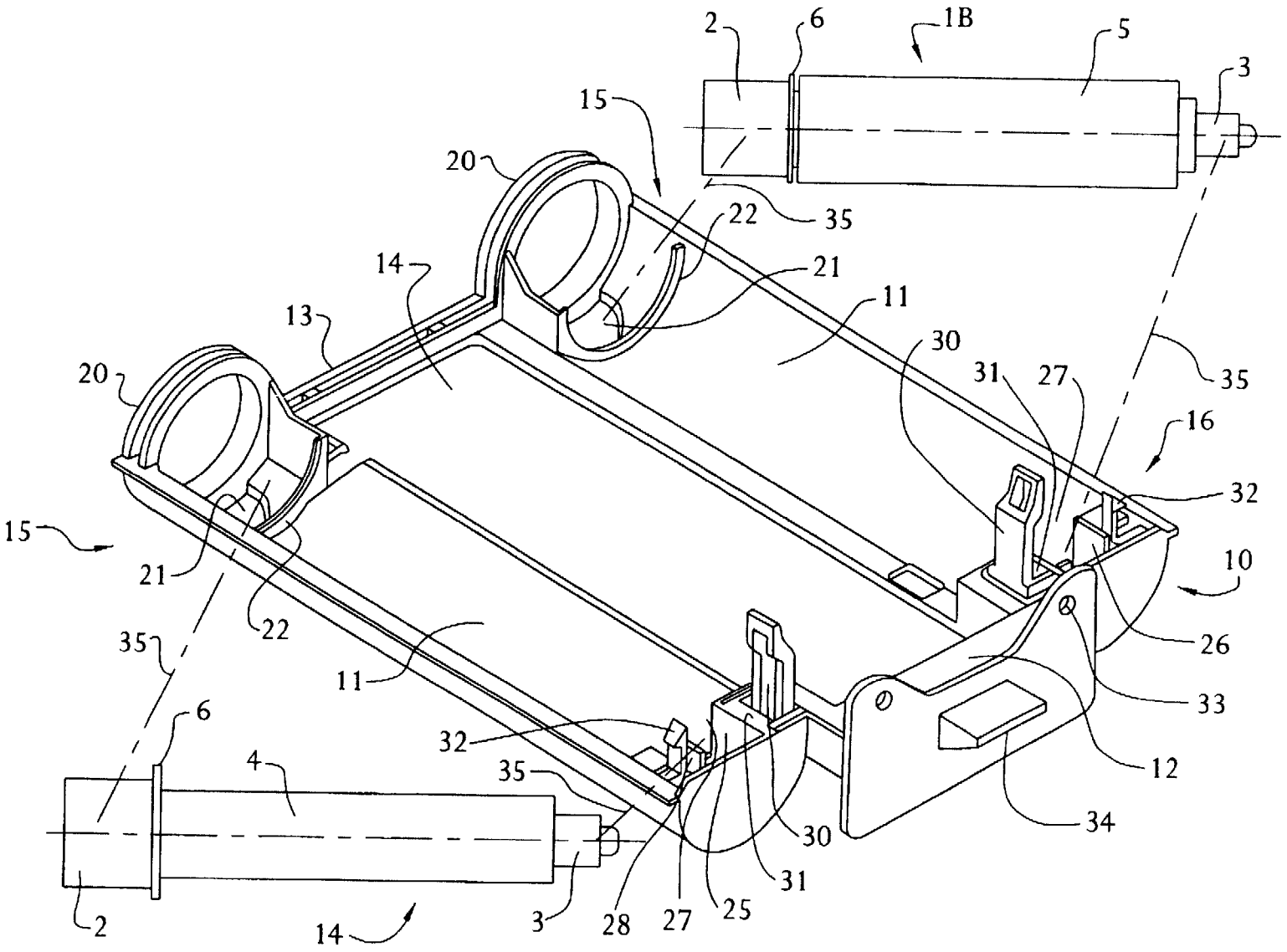
3
5
1B
6
2
35
22
15
20
14
13
21
11
30
31
27
16
32
10
26
33
12
34
25
28
4

THERMAL TRANSFER RIBBON CASSETTE

The invention relates to thermal transfer printing, and in particular to cassettes for holding the thermal transfer ribbons during storage and during use in thermal transfer printers.

Thermal transfer printing is a process for generating printed images by transferring thermally transferable colorant from a thermal transfer ribbon to a receiver. The ribbon comprises a base sheet coated on one side with a transfer coat, which usually comprises a non-transferable binder containing one or more thermally transferable dyes, or a fusible ink which is all transferable. Printing is effected while the transfer coat is held against the surface of the receiver, by heating selected areas of the ribbon so as to transfer the dyes or inks from those selected areas to corresponding areas of the receiver. This generates an image according to the areas selected. By repeating the transfer process with each of the three primary colours, full colour images can be obtained. Black may also be used.

Thermal transfer printers using a thermal head with a plurality of tiny heaters to heat the selected areas, have been gaining widespread attention in recent years, mainly because of its ease of operation in which the areas to be heated can be selected by electronic control of the heaters (e.g. according to a video or computer-generated signal), and because of the clear, high resolution images which can be obtained in this manner. Alternative thermal energy sources, such as addressable laser systems, are also being developed.

Transfer sheets for such printers are normally in the form of long ribbons, having sequences of print size panels of each primary colour and any other materials to be transferred (e.g. black dyes or ink), such sequence being repeated along the ribbon to enable it to be used for as many prints as there are repeats of the sequence. The ribbons are rolled up and stored in a cassette. These consist essentially of a supply spool, a take-up spool and a moulded casing; each spool having end portions and a bobbin portion on which is wound one end of the transfer ribbon, the moulded casing having locating means for engaging the spool end portions while the spools are in parallel and spaced apart positions with the transfer ribbon extending between them, and means to retain the spools in such positions. Initially the ribbon is on the supply spool, with one end extending across to the take-up spool, and it is progressively transferred to the take-up spool as it becomes used during printing.

Casings comprise two parallel spool-housings having end portions interconnected by bridge members such that the housings and bridge members together define an open access port through which the transfer ribbon is exposed as it extends from one spool to the other. To give the cassette rigidity, the cases have typically been constructed in two or more intricate moulded parts which are clipped or bonded together. This form of construction also enabled the spools to be loaded during assembly, and to be held permanently in place between the two mouldings. However, the casings of such cassettes generally represented a substantial proportion of the cost of the cassette, and after all the transfer ribbon had been used up, the expensive casing was simply discarded.

Even after assembly of the various mouldings to form a rigid casing, some other previously known cassettes did have an open configuration which left the spools and their spent transfer ribbons accessible for replacement, but such replacement was facilitated by permitting longitudinal movement of the spools in the casing from a free to a retained positions with coil springs around the spool ends to bias the spools into their retained positions, and the problem of assembling a plurality of mouldings was not avoided.

We have now developed a cassette of simple design, in which the features of the casing can be arranged so as to be mouldable as a single integrated moulding, using relatively small amounts of plastics material to form the casing (particularly important if it is to be thrown away as scrap after use); or the cassette can be refilled with new ribbon to recycle the casing and spools in an even more environmentally friendly fashion.

Accordingly, the present invention provides a thermal transfer ribbon cassette for use in a thermal transfer printer, the cassette comprising a supply spool, a take-up spool and a moulded casing; each spool having end portions and a bobbin portion on which is wound one end of the transfer ribbon, the moulded casing having locating means for engaging the spool end portions while the spools are in parallel and spaced apart positions with the transfer ribbon extending between them, and means to retain each spool in such position comprising a closable gate connected to the casing by an integrally moulded hinge.

Usually, each spool has one end adapted to be driven by driving means within the printer while the other end remains undriven. The configuration of the driven end is therefore at least partly determined by the configuration of the drive means with which it has to engage. There is more freedom for configuring the undriven end portion, which can, for example, have a concavity to receive coaxial locating means projecting from the casing. The gate is then closed to prevent reverse axial movement in a disengaging direction. However, we generally prefer the undriven end portion of each spool to comprise a spindle, and the casing's locating means for each such spindle to comprise a bearing surface and an opening to receive the spindle into contact with the bearing surface, the gate then being closed to retain the spindle in that received position.

Movement of the spindle into the hole can be axial, with the gate adapted to prevent reverse axial movement in a disengaging direction, when closed, as described for the alternative system above. However, we find that fresh spools can be loaded more readily by dropping the spindles at the undriven ends into locating means with a motion perpendicular to the spool axes, the driven ends also being located either in a similar manner or in a different manner more appropriate to the driven end.

To this purpose, a preferred cassette is one wherein the locating means for engaging the spindles at the undriven ends of the spools, each comprises a trough having an internal bearing surface and a longitudinal opening to receive the spindle into contact with the bearing surface, the gate being closable across the trough opening to retain the received spindle.

To hold the gate closed it may simply engage another part of the casing in an interference fit, so as to be held in position by friction. However, for greater security we prefer that the casing has latching means which engage as the gate is closed, thereby to retain the gate in its closed position and avoid unintentional release of the spindle.

We prefer the latching means to be readily releasable so as to enable spools to be loaded and unloaded from the casing very easily, and facilitate replacement of the ribbon-carrying spools after use.

A preferred cassette is one wherein the gate is of a size and in a position such that when closed, it is substantially confined to a position overlying at least a part of the spindle and does not overlap the ribbon wound onto the adjacent bobbin portion. When compared to a larger closure member extending over the ribbon, we find that by limiting the size of the gate in this way, we can significantly reduce the quantity of material required for the casing, while still effectively securing the loaded spool. However, when the roll of ribbon wound on the supply spool is left unprotected, it can easily become damaged as the cassette is inserted into a printer with a movement parallel to the axes of the spools, in the normal way.

To alleviate this problem, the casing adjacent to the driven ends of the spools can be provided with a ribbon-protecting barrier in a plane orthogonal to the spool axes, the barrier extending outwards at least as far from those axes as the outer surface of the roll of ribbon wound onto the supply spool. In this manner, direct contact between the printer and the end of the roll of ribbon when the cassette is inserted into the former, can be prevented by the intervening barrier. The barrier can suitably be an arcuate portion of the casing moulding, which serves also as a retaining ring for the spindle at the driven end of the spool.

For consistent operation during printing, it is desirable that the position of the transfer ribbon be reproducible controlled. When inserted into a printer, one end of each spool engages drive means in the printer, which in turn accurately positions the engaged end, but the undriven ends do not directly engage any part of the printer. The locating means for the driven ends of the spools should not hold those ends rigidly in position because that would not allow such positioning to be achieved by the printer drive means, and consequently the locating means at the driven end serves only to locate that spool end in the cassette while outside the printer. A simple, loose-fitting, arcuate moulding positioned around the spool end is all that is needed, although a hinged gate, like that described for the undriven end, could be used instead. However the position of the casing may be accurately controlled in a good design of printer, and all the locating means are thus correspondingly accurately positioned (being shaped parts of the casing), so can provide a reference for positioning the undriven ends of the spools.

In our preferred form of the present cassette, the two bearing means at the undriven ends of the spools each comprises substantially parallel first and second bearing surfaces on opposite sides of the trough, the two troughs being aligned back-to-back such that both first bearing surfaces are located between the two spools and the second bearing surfaces are located outside the two spools, wherein the first bearing surfaces are rigid, the second bearing surfaces are resilient, and the spindle portions are an interference fit between the first and second bearing surfaces.

The advantage of this is that the interference fit ensures that the spindle means is held against the rigid bearing surface by the resilient second bearing surface, and thus is positioned accurately. However, it is important to ensure that it is the first bearing surface (i.e. the bearing surface between the two spindles) which is the rigid surface, because during printing the exposed portion of ribbon by the access port is pressed between a thermal head and a platten in the printer, and this tends to pull the spools inwards towards each other, which movement is resisted by the inner bearing surface being the rigid one.

Our preferred casing is a single one-piece moulding, with all locating means, gates and any latching means for securing the gates, being incorporated as integral mouldings.

To illustrate the invention, a specific embodiment thereof is shown in the accompanying drawing, which is an isometric view of a casing according to the invention, and side elevations of a full spool and an empty spool, with indications how these fit into the casing.

The spools 1A and 1B each have a broad spindle 2, a narrower spindle 3 and a bobbin portion 4 between them, on which can be wound a roll of dyesheet ribbon 5. Between the broad spindle 2 and the bobbin portion 4 is provided a circumferential flange 6. The broad spindle is hollow, with internal knurls (not shown) for engaging driving means in the printer.

The casing 10 comprises two parallel hemi-cylindrical spool-housings 11, having end portions interconnected by bridge members 12 and 13, such that the housings and bridge members together define an open access port 14. At each end of the housings are locating means 15 and 16. The rear locating means 15 at the driven end have retaining rings 20 (which extend outwards a little further than the roll of ribbon 5 wound onto the supply spool, and hence also serves as a ribbon-protecting barrier), a hole 21 (for receiving holding latches in a printer), and a rib 22. The front locating means 16, at the undriven ends, each have a first bearing surface 25 and a second bearing surface 26 lying parallel and extending from the housing 11 to define between them a trough with its longitudinal opening 27 between the spaced extended edges of the bearing surfaces. The rearward ends of the troughs (i.e. the ends towards the other locating means) are also open to a depth equivalent to the diameter of the narrower spindle portions 3, but the other end of each trough is closed, to protect the ribbon against damage and ingress of dust while in the printer. The first bearing surface 25 is provided by a rigidly constructed part of the casing which can resist inward pull from the ribbon. The second bearing surface 26 is provided by an elongated flange 28 extending from the housing 11 with sufficient natural resilience to hold the spindle firmly against the position-determining rigid first surface 25.

Adjacent to the first bearing surface 25 is a gate 30 connected to the casing 10 by an integrally moulded hinge 31. Adjacent to the second bearing surface 26 is a latch 32. Also illustrated are positioning holes 33 to locate the casing accurately in the printer, and a handle 34 by which the cassette may be handled while avoiding contaminating contact with the ribbon.

The cassette is assembled by inserting the broad spindle portions 2 through the retaining rings 20 in the rear locating means 15 until the flanges 6 engage the ribs 22. The narrower spindle portions 3 are then lowered through the openings 27 until they engage the bearing surfaces 25,26 of the front locating means 16. Guide lines 35 have been added to indicate where the spindle portions will then reside. They are then locked in place by closing each gate 30 until it engages its latch 32. Generally the dyesheet ribbon 5 will have been wound onto the two spools before they are inserted into the casing. It is wound onto the two spools in opposite directions such that as it extends between them it passes close to the access port 14 in conventional manner.

I claim:

1. A thermal transfer ribbon cassette for use in a thermal transfer printer, the cassette comprising a supply spool, a take-up spool and a moulded casing; each spool having end portions and a bobbin portion on which is wound one end of the transfer ribbon, the moulded casing having locating means for engaging the spool end portions while the spools are in parallel and spaced apart positions with the transfer ribbon extending between them, and means to retain the spools in such positions while the ribbon is progressively transferred from the supply spool to the take-up spool during printing, wherein said means for retaining each spool comprises a closable gate connected to the casing by an integrally moulded hinge.

2. A cassette as claimed in claim 1 in which each spool has one end adapted to be driven by driving means within the printer while the other end remains undriven, wherein the undriven end portion of each spool comprises a spindle, and the casing's locating means for each such spindle comprising a bearing surface and an opening to receive the spindle into contact with the bearing surface, the gate being closable to retain the spindle in that received position.

3. A cassette as claimed in claim 2, wherein the locating means for engaging the spindles at the undriven ends of the spools, each comprises a trough having an internal bearing surface and a longitudinal opening to receive the spindle into contact with the bearing surface, the gate being closable across the trough opening to retain the received spindle.

4. A cassette as claimed in claim 3, wherein the gate is of a size and in a position such that when closed, it is substantially confined to a position overlying at least a part of the spindle and does not overlap the ribbon wound onto the adjacent bobbin portion.

5. A cassette as claimed in claim 4 wherein the casing adjacent to the driven ends of the spools is provided with a ribbon-protecting barrier in a plane orthogonal to the spool axes, the barrier extending outwards at least as far from those axes as the outer surface of the roll of ribbon wound onto the supply spool.

6. A cassette as claimed in claim 2, wherein the two locating means at the undriven ends of the spools each comprises substantially parallel first and second bearing surfaces on opposite sides of the trough, the two troughs being aligned back-to-back such that both first bearing surfaces are located between the two spools and the second bearing surfaces are located outside the two spools, and wherein the first bearing surfaces are rigid, the second bearing surfaces are resilient, and the spindle portions are an interference fit between the first and second bearing surfaces.

7. A cassette as claimed in claim 1, wherein the latching means is releasable thereby to facilitate replacement of the ribbon-carrying spools after use.

8. A cassette as claimed in claim 1, wherein the casing is a single one-piece moulding, with the locating means, gates and any latching means for securing the gates being incorporated as integral mouldings.

9. A thermal transfer ribbon cassette for use in a thermal transfer printer, the cassette comprising a supply spool, a take-up spool and a moulded casing; each spool having end portions and a bobbin portion on which is wound one end of the transfer ribbon, the moulded casing having locating means for engaging the spool end portions while the spools are in parallel and spaced apart positions with the transfer ribbon extending between them, wherein the locating means at the undriven ends of the spools each comprises substantially parallel first and second bearing surfaces on opposite sides of a trough, the two troughs being aligned back-to-back such that both first bearing surfaces are located between the two spools and the second bearing surfaces are located outside the two spools, and wherein the first bearing surfaces are rigid, the second bearing surfaces are resilient, and the spindle portions are an interference fit between the first and second bearing surfaces, and means are provided to retain the respective spools in position, each retaining means comprising a gate hinged to the casing to be closeable over the corresponding trough.

10. A cassette as claimed in claim 9, wherein the gate is of a size and in a position such that when closed, it is substantially confined to a position overlying at least a part of the spindle and does not overlap the ribbon wound onto the adjacent bobbin portion.

11. A cassette as claimed in claim 10, wherein the casing adjacent to the driven ends of the spools is provided with a ribbon-protecting barrier in a plane orthogonal to the spool axes, the barrier extending outwards at least as far from those axes as the outer surface of the roll of ribbon wound onto the supply spool.

12. A cassette as claimed in claim 9, wherein the casing is a single one-piece moulding, with all locating means, gates and any latching means for securing the gates being incorporated as integral mouldings.

* * * * *

UNITED STATES PATENT AND TRADEMARK OFFICE

CERTIFICATE OF CORRECTION

PATENT NO. : 5,795,083

DATED : August 18, 1998

INVENTOR(S) : GALLAGHER

It is certified that error appears in the above-identified patent and that said Letters Patent is hereby corrected as shown below:

Claim 1, line 66, delete "closable".

Claim 1, line 67 after "hinge", insert --about which the gate is closeable over a spool end portion wherein the casing has latching means which engage as the gate is closed, thereby to retain the gate in its closed position--

Signed and Sealed this

Third Day of April, 2001

Nicholas P. Godici

*Attest:*

NICHOLAS P. GODICI

*Attesting Officer*

*Acting Director of the United States Patent and Trademark Office*